United States Patent [19]

Ekberg, Jr.

[11] Patent Number: 4,809,474

[45] Date of Patent: Mar. 7, 1989

[54] PRESTRESSED COMPOSITE FLOOR SLAB AND METHOD OF MAKING THE SAME

[75] Inventor: Carl E. Ekberg, Jr., Ames, Iowa

[73] Assignee: Iowa State University Research Foundation, Inc., Ames, Iowa

[21] Appl. No.: 176,629

[22] Filed: Apr. 1, 1988

[51] Int. Cl.[4] ..... E04C 3/10

[52] U.S. Cl. ..... 52/223 R; 52/335; 52/448; 52/450; 52/745

[58] Field of Search ..... 52/223 R, 332, 335, 52/336, 448, 446, 450, 602, 745, 322, 414

[56] References Cited

U.S. PATENT DOCUMENTS

| | | | |
|---|---|---|---|
| 2,839,812 | 6/1958 | Berliner | 25/154 |
| 3,113,402 | 12/1963 | Butler | 50/531 |
| 3,712,010 | 1/1973 | Porter et al. | 52/223 R |
| 3,732,656 | 5/1973 | Robinsky | 52/223 X |
| 4,285,173 | 7/1981 | Grearson et al. | 52/602 |
| 4,453,364 | 6/1984 | Ting | 52/630 |
| 4,630,414 | 12/1986 | Ting | 52/220 |
| 4,637,184 | 1/1987 | Radtke et al. | 52/220 |

*Primary Examiner*—Carl D. Friedman

*Attorney, Agent, or Firm*—Zarley, McKee, Thomte, Voorhees & Sease

[57] ABSTRACT

A method of making a prestressed floor slab unit and floor system is disclosed involving the steps of creating a slab unit by imposing a first concrete slab over the central longitudinal portion of a corrugated cold formed steel deck sheet of generally rectangular shape, with the side edges of the sheet remaining exposed. The slab can be prestressed by conventional means by stressing tendons extending longitudinally through the concrete, to create an upward camber to the finished slab. A plurality of these finished slabs are then placed side by side to span the distance between spaced supporting beams. The side edges of the deck sheets are interlocked together by interlocking surfaces on the side edges to form empty trough portions. A second concrete slab is then poured over a plurality of the assembled slab units to fill the empty trough portions and to provide an additional slab layer over the concrete slabs of each slab unit. The weight of the additional slab layer preferably will remove the upward camber of the individual slab units. The apparatus of this invention involves the structure of the above described slab units and the completed floor system.

13 Claims, 1 Drawing Sheet

PRESTRESSED COMPOSITE FLOOR SLAB AND METHOD OF MAKING THE SAME

BACKGROUND OF THE INVENTION

Concrete floor systems in multi-story buildings are often cast in place between horizontal beam supports that will ultimately support the floor system when the concrete cures. Construction of this type requires many concrete forms which must be supported by considerable shoring.

Therefore, a principal object of the invention is to provide a prestressed composite floor slab which will not require shoring, and which will provide a strong floor with a minimum thickness and a minimum of concrete material.

A further object of this invention is to provide a prestressed composite floor slab which can be prestressed even though the final slab surface is poured in place.

A still further object of the invention is to provide a prestressed composite floor slab which can be partially pre-fabricated.

These and other objects will be apparent to those skilled in the art.

SUMMARY OF THE INVENTION

The method of the invention involves the steps of creating a slab unit by imposing a first concrete slab over the central longitudinal portion of a corrugated cold formed steel deck sheet of generally rectangular shape, with the side edges of the sheet remaining exposed. The slab can be prestressed by conventional means by stressing tendons extending longitudinally through the concrete, to create an upward camber to the finished slab. A plurality of these finished slabs are then placed side by side to span the distance between spaced supporting beams. The side edges of the deck sheets are interlocked together by interlocking surfaces on the side edges to form an empty trough portions. A second concrete slab is then poured over a plurality of the assembled slab units to fill the empty trough portions and to provide an additional slab layer over the concrete slabs of each slab unit. The weight of the additional slab layer preferably will remove the upward camber of the individual slab units. The apparatus of this invention involves the structure of the above described slab units and the completed floor system.

BRIEF DESCRIPTION OF THE DRAWINGS

FIG. 8 is taken on line 8—8 of FIG. 6.

DESCRIPTION OF THE PREFERRED EMBODIMENT

Figure 1:
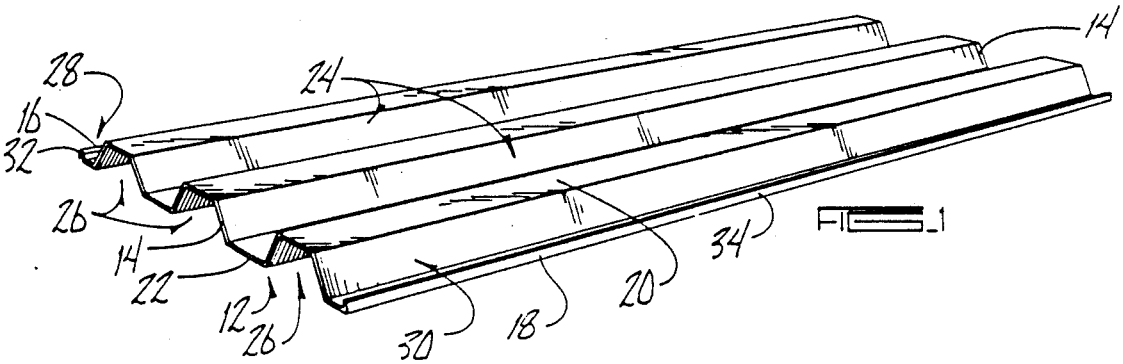
FIG. 1 is a perspective view of the steel deck sheet that undergirds each slab unit.
Figure 2:
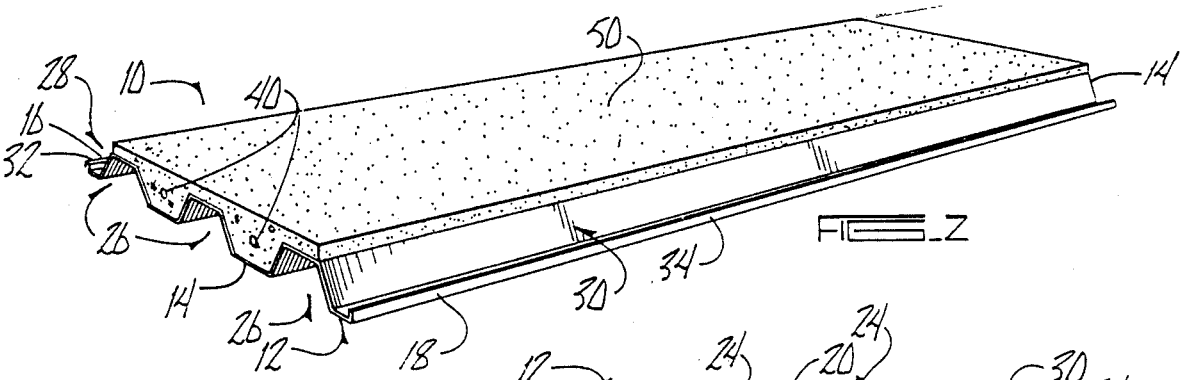
FIG. 2 is a perspective view of one of the slab units of the invention.
Figure 3:
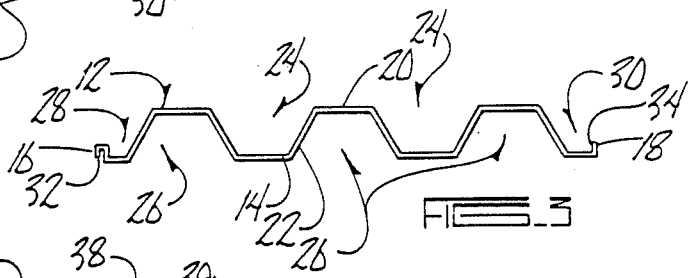
FIG. 3 is an enlarged scale end elevational view of the steel deck sheet.
Figure 5:
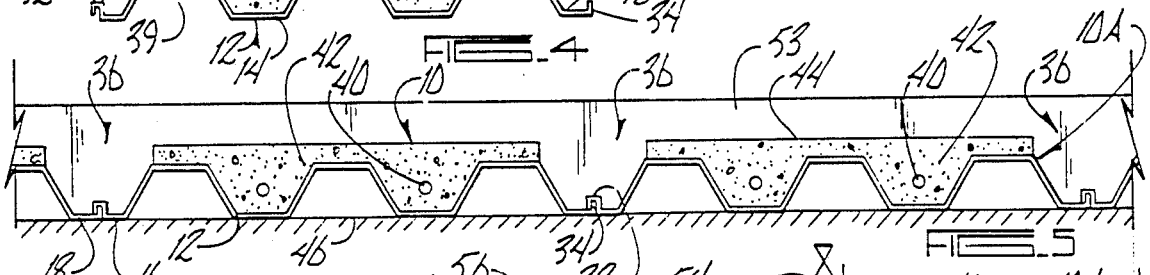
FIG. 5 is an end view of several assembled slab units with an end form in place.
Figure 6:
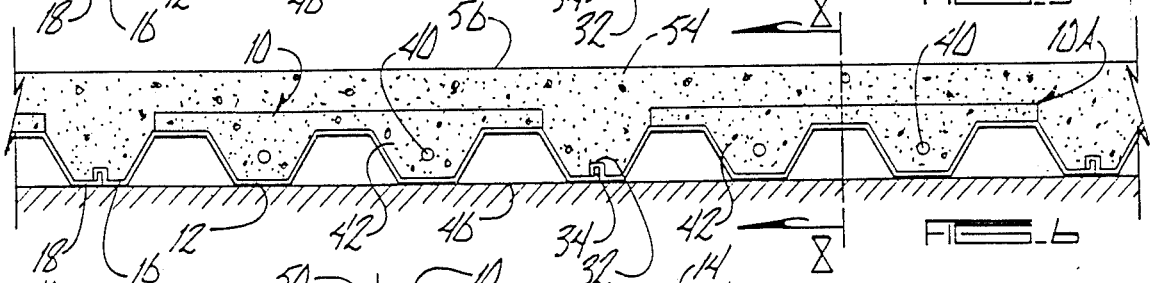
FIG. 6 is a view similar to that of FIG. 5 but with the final concrete slab in place.

The numeral 10 designates a floor slab unit, and an identical floor slab unit 10*a* is shown in FIGS. 5 and 6. Slab unit 10 (and 10*a*) is comprised of an elongated corrugated cold formed steel deck sheet 12 having opposite ends 14, side edges 16 and 18, top surface 20, and bottom surface 22 (FIG. 3). The corrugations of sheet 12 create downwardly extending troughs 24 (preferably two in number). Upwardly extending troughs 26 are thereupon created on the bottom surface 22. Half trough portions 28 and 30, respectively, are formed along the sides 16 and 18 of sheet 12. The sides 16 and 18 terminate in inverted U-shaped portion 32 and upstanding flange 34, respectively. When a flange 34 of one slab unit is interlocked with U-shaped portion 32 of an adjacent slab unit by extending into the U-shaped portion, a composite downwardly extending trough 36 is formed between the adjacent slab units 10 and 10*a* (FIG. 5).

Figure 4:
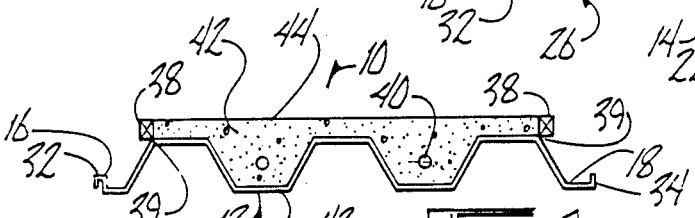
FIG. 4 is a view similar to that of FIG. 3 but shows the concrete slab in place on the steel deck sheet.
Figure 7:
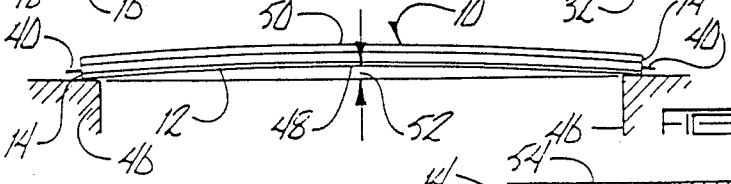
FIG. 7 is a small scale side view of a slab unit spanning the space between two supports.

The sheet 12 of FIG. 3 has suitable end concrete forms (not shown) placed against the ends 14 thereof, and side forms 38 (FIG. 4) placed on top and adjacent the outside edge 39 of troughs 26. Pre-tensioning tendons 40 are placed in trough 40. Tendons 40 extend through the end forms (not shown) and are adapted to be tensioned through conventional procedures. A quantity of plastic concrete 42 is then placed on sheet 12 within the confines of forms 38. Sufficient concrete is used to create a first continuous slab 44 which extends across and between both troughs 24 and 26. The concrete is allowed to cure for 10–12 hours, and the tension on tendons 40 is released. Since the tendons are in the lower portion of the concrete (below the neutral axis thereof), the resulting floor slab unit 10 is cambored in an upwardly direction. Thus, when slab unit 10 has its opposite ends placed on supports 46 (e.g., beams, etc.), the center portion 50 is curved or cambored upwardly at 48 (FIG. 7) a distance denoted by the numeral 52. Again, this prestressing concept used with this invention is old per se and does not of itself comprise the invention herein. The protruding ends of tendon 40 can be removed, if desired, after concrete 42 cures and tension on the tendons is released.

When a plurality of slab units 10 and 10*a* are completed as described above, they are transported to the building under construction where they will comprise a part of an elevated floor system. The slab units have their ends supported by supports 46 which can comprise steel or concrete beams. The slab units have sufficient strength through slab 44 to support both their own weight and the weight of a second layer of concrete to be described. Obviously, the thickness of the slab units 10 and 10*a* must be designed to take into account their own weight, the weight of the slab to be poured, and the distance being spanned.

Figure 8:
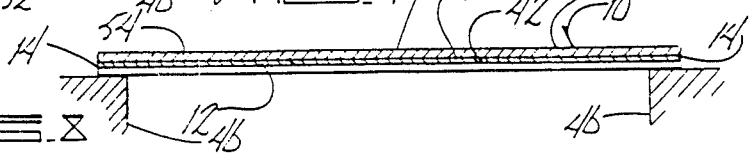
FIG. 8 is a sectional view (similar to FIG. 7) but with the final concrete slab in place.

When the slab units 10 and 10*a* are assembled in the building being constructed, the flanges 34 on one edge of each is inverted into the inverted U-shaped portion 32 of the adjacent slab unit to create further composite corrugation 36. The slabs are thereupon interlocked together. If necessary, additional suitable reinforcing can then be placed on the assembled slabs. End concrete form 53 (FIG. 5) can be placed adjacent the ends of the slab units. A second quantity of concrete 54 is then placed on the assembled slab units to create a continuous slab 56 completely across the slabs 44 and troughs 36. Appropriate end forms (not shown) are used at the ends of slab units 10 and 10*a* as the concrete 54 is being poured. The weight of the concrete 54 preferably causes the camber of the slab units 10 and 10*a* to deflect downwardly (FIG. 8), so there is "zero" deflection of the floor system. The upper surface of the slab 56 can be finished as required by the use of the building.

Thus, it is seen that this invention results in a floor system that is easy and relatively inexpensive to build, and which is strong despite a relatively shallow depth. The slab units 10 and 10*a* including slabs 44 and sheets 12, support the dead load of the floor system, while the upper slab 56 is adapted to support the live loads imposed on the system when it is in use. A broomed upper surface on slabs 44 interlocks with top slab 56 to cause the two slabs to function structurally as a single slab. The floor system can be constructed quickly without the use of shoring.

Thus, it is seen that this invention will accomplish at least all of its stated objectives.

I claim:

1. The method of making a floor slab, comprising, taking a plurality of elongated corrugated metal sheets each having first and second side edges, opposite ends, top and bottom and surfaces, a plurality of elongated corrugations extending between said ends and creating downwardly extending elongated troughs in said upper surface, and upwardly extending troughs in said bottom surface, with at least a portion of a downwardly extending trough appearing adjacent each of said sides, pouring a quantity of plastic concrete in the centermost downwardly extending troughs while leaving at least the trough portions adjacent each of said sides free of concrete; said concrete being poured to a vertical depth greater than the depth of said downwardly extending troughs to create a first continuous concrete slab over all of said downwardly extending troughs containing concrete, allowing said concrete to cure to create a plurality of floor slab units, assembling a plurality of said floor slab units in juxtaposition with the ends thereof on a support structure and with the sides thereof being in operative engagement to form at least one open and downwardly extending elongated side trough adjacent abutting sides of said slab units, pouring a second quantity of plastic concrete over the assembled floor slab units to fill side troughs and to create a second continuous concrete slab over all of said assembled floor slab units, and allowing said second quantity of concrete to cure.

2. The method of claim 1 wherein said floor slab units are prestressed to create an upward camber in the center thereof with respect to the ends, with said floor slab units being prestressed during construction thereof and before being placed on said supporting structure.

3. The method of claim 2 wherein the weight of said second quantity of plastic concrete deflects downwardly the centers of said floor slab units to offset said upward camber.

4. The method of claim 1 wherein the side edges of said corrugated sheets are interlocked with the sides of adjacent corrugated sheets when said slab units are assembled in juxtaposition.

5. The method of making a floor unit, comprising, taking a plurality of elongated corrugated metal sheets each having first and second side edges, opposite ends top and bottom and surfaces a plurality of elongated corrugations extending between said ends and creating downwardly extending elongated troughs in said upper surface, and upwardly extending troughs in said bottom surface, with at least a portion of a downwardly extending trough appearing adjacent each of said sides, pouring a quantity of plastic concrete in the centermost downwardly extending troughs while leaving at least the trough portions adjacent each of said sides free of concrete; said concrete being poured to a vertical depth greater than the depth of said downwardly extending troughs to create a first continuous concrete slab over all of said downwardly extending troughs containing concrete, allowing said concrete to cure.

6. The method of claim 5 wherein said floor slab unit is prestressed to create an upward camber in the center thereof with respect to the ends.

7. A floor slab unit, comprising, an elongated, corrugated metal sheet having first and second side edges, opposite ends, top and bottom surfaces, and a plurality of elongated corrugations extending between said ends and creating downwardly extending elongated troughs in said upper surface, and upwardly extending troughs in said bottom surface, with at least a portion of a downwardly extending trough appearing adjacent each of said sides, and a quantity of hardened concrete in the centermost downwardly extending troughs with the trough portions adjacent each of said sides being free of concrete; said concrete having a vertical depth greater than the depth of said downwardly extending troughs to create a first continuous concrete slab over all of said downwardly extending troughs containing concrete.

8. The floor slab unit of claim 7 wherein the side edges of said corrugated sheets include means for interlocking said side edges with the side edges of adjacent juxtapositioned floor slab units of like construction.

9. The floor slab unit of claim 7 wherein said floor slab unit is prestressed to create an upper camber in the center thereof with respect to the ends.

10. A composite floor slab, comprising, a plurality of elongated, corrugated metal sheets, each sheet having first and second side edges, opposite ends, top and bottom surfaces, and a plurality of elongated corrugations extending between said ends and creating downwardly extending elongated troughs in said upper surface, and upwardly extending troughs in said bottom surface, with at least a portion of a downwardly extending trough appearing adjacent each of said sides, a quantity of hardened concrete in the center-most downwardly extending troughs with the trough portions adjacent each of said sides being free of concrete; said concrete having a vertical depth greater than the depth of said downwardly extending troughs to create a first continuous concrete slab over all of said downwardly extending troughs containing concrete to form a flow slab unit, oppositely disposed support means with an open span therebetween, a plurality of floor slab units juxtapositioned with their opposite ends in supporting engagement with said support means, a second continuous concrete slab extending over all the first concrete slabs of said floor slab units and filling the portions of downwardly extending troughs adjacent the abutting sides of the metal sheets of said floor slab units.

11. The composite floor slab of claim 10 wherein the adjacent side edges of the sheets of said juxtapositioned floor slab units are interlocked together.

12. The composite floor slab of claim 10 wherein said floor slab units are prestressed to create an upward camber in the center thereof with respect to the ends, with said floor slab units being prestressed during construction thereof and before being placed on said supporting structure.

13. The composite floor slab of claim 12 wherein the weight of said second continuous concrete slab deflects downwardly the centers of said floor slab units to offset said upward camber.

* * * * *